US005628177A

United States Patent [19]

Ballhausen et al.

[11] Patent Number: 5,628,177

[45] Date of Patent: May 13, 1997

[54] METHOD AND DEVICE FOR MANUFACTURING A TWISTED YARN IN AN INTEGRATED SPIN-TWISTING PROCESS ACCORDING TO THE TWO-FOR-ONE TWISTING METHOD FROM DISSOLVED FIBER MATERIAL

[75] Inventors: Ulrich Ballhausen, Krefeld; Guido Spix, Kaarst; Wilfried Rütten, Wegberg, all of Germany

[73] Assignee: Palitex Project-Company GmbH, Krefeld, Germany

[21] Appl. No.: 511,710

[22] Filed: Aug. 4, 1995

[30] Foreign Application Priority Data

Aug. 6, 1994 [DE] Germany ..... 44 27 875.6

[51] Int. Cl.[6] ..... D01H 4/00; D01H 1/00

[52] U.S. Cl. ..... 57/406; 57/58.49; 57/58.52; 57/58.7; 57/58.83; 57/59; 57/60; 57/408; 57/409; 57/411

[58] Field of Search ..... 57/406, 408, 409, 57/411, 59, 60, 58.49, 58.52, 58.7, 58.83

[56] References Cited

U.S. PATENT DOCUMENTS

| | | | |
|---|---|---|---|
| 4,391,087 | 7/1983 | Greive et al. | 57/58.52 |
| 5,428,948 | 7/1995 | Ballhausen et al. | 57/58.49 |
| 5,479,711 | 1/1996 | Ballhausen et al. | 57/406 |
| 5,499,496 | 3/1996 | Stenmans | 57/406 |

FOREIGN PATENT DOCUMENTS

| | | | |
|---|---|---|---|
| 2354403 | 1/1978 | France . | |
| 78710 | 8/1969 | Germany . | |
| 254364 | 5/1968 | U.S.S.R. | 57/58.52 |

*Primary Examiner*—William Stryjewski

*Attorney, Agent, or Firm*—Robert W. Becker & Associates

[57] ABSTRACT

In a method for manufacturing a twisted yarn by an integrated spinning-twisting process a vacuum is generated within the spindle rotor. Individual staple fibers are fed by vacuum to at least two rotor spinning devices positioned within the spindle rotor in which individual spun yarns are spun from the individual staple fibers. The individual spun yarns are gathered and guided in a first direction through the spindle rotor in order to subject the individual spun yarns to a first twist. The twisted yarn is guided in a second direction counter to the first direction to a centering element positioned above the rotor spinning devices whereby the twisted yarn forms a rotating yarn balloon about the spindle rotor. The twisted yarn is then wound onto a bobbin. Feeding of the individual staple fibers includes supplying them essentially in a radially inward direction through a fiber material feed tube to an annular space, positioned at the spindle rotor coaxially to a central axis of the yarn balloon, and from the annular space through respective fiber material supply channels to the at least two rotor spinning devices. The envelope of the yarn balloon extends through the annular space and the individual staple fibers pass through the yarn balloon. In the step of guiding the twisted yarn in a second direction counter to the first direction the twisted yarn is routed through a yarn guide element rotating with the yarn balloon.

12 Claims, 5 Drawing Sheets

FIG−1

METHOD AND DEVICE FOR MANUFACTURING A TWISTED YARN IN AN INTEGRATED SPIN-TWISTING PROCESS ACCORDING TO THE TWO-FOR-ONE TWISTING METHOD FROM DISSOLVED FIBER MATERIAL

BACKGROUND OF THE INVENTION

The best known method for manufacturing a twisted yarn comprises in a first step the manufacture of spun yarns with a suitable spinning device from dissolved fiber material; in a subsequent method step the spun yarns are twisted in twisting devices, for example, two-for-one twisting devices to a twisted yarn. A spooling process and occasionally a doubling process are provided between these two method steps. For the manufacture of a twisted yarn it is thus necessary to provide individual, separately acting spinning machines, on the one hand, and twisting machines, on the other hand; this is complicated with respect to device requirements as well as with respect to the operational sequence.

From the publications DD 78 710 and FR-A-2 354 403 methods and devices are known with which individual spun yarns are manufactured by means of two adjacent spinning devices, i.e., positioned next to each other or atop one another, the spun fibers are joined immediately after the spinning process and are subjected to twisting.

The object of the invention is to create a method and a device by means of which the fiber material is introduced in a fiber stream that is as uniform as possible and loss-free through the surrounding envelope of the yarn balloon into the interior space defined by the yarn balloon and supplied to the spinning devices.

SUMMARY OF THE INVENTION

The inventive method for manufacturing a twisted yarn by an integrated spinning-twisting process is primarily characterized by the following steps:

generating a vacuum within the spindle rotor;

dissolving fiber material to produce individual staple fibers;

feeding the individual staple fibers by means of the vacuum to at least two rotor spinning devices positioned within the spindle rotor;

spinning in the rotor spinning devices individual spun yarns from the individual staple fibers;

gathering the individual spun yarns from the rotor spinning devices and guiding the individual spun yarn in a first direction through the spindle rotor in order to subject the individual spun yarns to a first twist to form a twisted yarn;

guiding the twisted yarn in a second direction counter to the first direction to a centering element positioned above the rotor spinning devices whereby the twisted yarn forms a rotating yarn balloon about the spindle rotor;

winding the twisted yarn onto a bobbin;

wherein the step of feeding the individual staple fibers includes the steps of supplying essentially in a radially inward direction the individual staple fibers through a fiber material feed tube to an annular space, positioned at the spindle rotor coaxially to a central axis of the yarn balloon, and from the annular space through respective fiber material supply channels to the at least two rotor spinning devices, wherein the envelope of the yarn balloon extends through the annular space and wherein the individual staple fibers pass through the yarn balloon; and wherein the step of guiding the twisted yarn in a second direction counter to the first direction includes the step of routing the twisted yarn through a yarn guide element rotating with the yarn balloon.

Preferably, the method further includes the step of positioning the outlet opening of the fiber material feed tube into the annular space and the inlet opening of the fiber material supply channel into the annular space radially opposite one another.

In the alternative the method further includes the step of positioning the outlet opening of the fiber material feed tube into the annular space so as to be spaced in the circumferential direction of the annular space from the inlet opening of the fiber material supply channel into the annular space in a direction of rotation of the yarn balloon.

The present invention also relates to a spinning and twisting device characterized primarily by:

a spindle rail;

at least one spindle comprising a spindle rotor rotatably connected to the spindle rail, an interior casing surrounding the spindle rotor coaxially, and an exterior housing enclosing the interior casing;

the spindle rotor comprising a hollow spindle axle and a yarn guide channel connected to the hollow spindle axle so as to extend radially outwardly from the hollow spindle axle;

a centering element positioned above the hollow spindle axle on an extension of the axis of rotation of the hollow spindle axle;

at least two rotor spinning devices positioned within the interior casing;

a device for feeding individual staple fibers to the at least two rotor spinning devices, wherein the individual staple fibers are spun to spun yarns in the rotor spinning devices, guided through the hollow spindle axle and through the yarn guide channel to the exterior of the interior casing and to the centering element while forming a yarn balloon between the yarn guide channel and the centering element;

each one of the rotor spinning devices having coordinated therewith a fiber material supply channel positioned within the interior casing;

each one of the fiber material supply channels having an inlet opening at the outer wall of the interior casing;

each one of the fiber material supply channels having coordinated therewith a fiber material feed tube located in the exterior housing and having an outlet opening positioned at an inner wall of the exterior housing;

each one of the rotor spinning devices having coordinated therewith a spun yarn removal tube for guiding the spun yarns from the rotor spinning devices to the hollow spindle axle where a twisted yarn is formed from the spun yarns;

a rotating component arranged coaxially to the hollow spindle axle between the interior casing and the exterior housing and rotating with the yarn balloon, the rotating component comprising an integral yarn guide element for guiding at least over a portion of the height of the yarn balloon the twisted yarn;

the rotating component comprising two annular members positioned opposite one another so as to delimit therebetween an annular space into which the inlet opening of the fiber material supply channels and the outlet opening of the fiber material feed tubes open; and the rotating component further comprising at least one connecting element for connecting the two annular members, the connecting elements extending through the annular space, wherein the integral yarn guide element extends through one of the at least one connecting elements.

Expediently, the inlet openings of the fiber material supply channels are spaced in the circumferential direction of the annular space from the inlet opening of the fiber material supply channel into the annular space in a direction of rotation of the rotating component.

In preferred embodiment of the Invention, three of the connecting elements are provided.

Between the inner wall of the exterior housing and the annular members first gaps are formed and between the outer wall of the interior casing and the annular members second gaps are formed, the device further comprising gap seals in the form of labyrinth seals for the first and second gaps, wherein the annular space is subjected to a vacuum. The labyrinth seals in a circumferential direction of the annular space preferably have return threads of opposite pitch orientation relative to the annular space.

Expediently, the width of the at least one connecting element in a circumferential direction of the rotating component is greater than half a length of a longest individual staple fiber within the supplied fiber material.

Preferably, the annular space is positioned at a maximum radial extension of the interior casing.

In another embodiment of the present invention, the rotating component is a pot fixedly connected to the spindle rotor. The annular members are positioned at an upper end of the pot, and the yarn guide element extends through a wall of the pot upwardly into one of the at least one connecting elements.

According to another embodiment of the invention, the rotating component is a wheel of a conical shape rotatably connected above the spindle rotor in the area of the centering element. The conical shape has a tip that faces away from the interior casing. The wheel has an outer edge that overlaps the upper edge of the interior casing and the annular members connected to the outer edge. The yarn guide element is in the form of a yarn guide tube extending from the outer edge through one of the at least one connecting elements to the centering element. Preferably, the exterior housing comprising a stationary cover positioned above the wheel.

The invention thus is based on the principle of the older application to integrate spinning devices into a twisting device essentially constructed according to the two-for-one twisting method such that the spun yarns produced by means of the spinning devices are joined in a continuous operational process immediately following their production and are subjected to two twisting rotations according to the two-for-one twisting method and are manufactured into a twisted yarn.

Possible ways for feeding the fiber material to the space encompassed by the yarn balloon are described, for example, in the U.S. Pat. No. 5,428,948.

A basic idea of the present invention is to first feed the dissolved fiber material to an annular space located in the area of the fiber material inlet coaxial to the hollow spindle axle. The yarn forming the yarn balloon is guided through this annular space such that it passes through the annular space within a kind of pillar or spoke which is a part of a rotating component so that the yarn passing through the yarn balloon does not directly contact the supplied fiber material. The fiber material is fed to the annular space from the exterior in the radial direction, guided out of the annular space toward the interior, and supplied to the spinning devices. The spoke or pillar through which the yarn is guided can be embodied such that no fibers can be caught thereat. The conveyance of the fiber material into the annular space and out of the annular space can be carried out by means of a vacuum. The fiber material is expediently guided out of the annular space at a location which is offset in rotating direction of the spoke or pillar at a defined distance at the circumference of the annular space. The length of the offset-distance is a function of the component of movement in the circumferential direction which the fiber material receives on entering the annular space.

How heavily the fiber stream is disrupted on passing through the annular space is dependent on the relation of the width of the spokes or pillars in the circumferential direction relative to the entire circumference of the annular space.

It has been demonstrated that the annular space performs a storage function even though the supply and removal of the fiber material is carried out essentially at the same location of the annular space. The passing-by of the spoke or pillar at the location of supply, respectively, removal, however, may occasionally produce a disruption of the fiber stream and can result in a drifting of a single or several fibers from the fiber stream. However, it has surprisingly be found that a single fiber that has been separated from the remaining fiber stream is being forced into a single or several revolutions about the spindle within the annular space and rejoins the fiber stream running toward the spinning device due to the vacuum. In this case the annular space takes over a storage function for individual fibers that have been separated from the fiber stream.

In principle, the annular space can be positioned practically at any location of the contour of the yarn balloon. Advantageously, however, the rotating component, and thus the annular space, is positioned such that the largest possible radial extension is achieved. Since the width of the spokes or pillars in the circumferential direction, as is explained in more detailed infra, is essentially defined by the maximum length of the fibers to be supplied and is independent from the radius of the annular space, the overlap of the rotating spokes or pillars relative to the inlet and outlet openings decreases the more the larger the radius of the annular space is. That means, the disruption-free interval for the supply of the material stream into the interior of the yarn balloon increases when the radius of the annular space is enlarged.

The rotating component through which the yarn that passes through the yarn balloon is guided can be, as is shown in the following with the aid of embodied examples, a part of a structural member of the spindle as a whole, for example, a part of the also rotating balloon limiter that is connected to the spindle rotor disk or a part of a guide for guiding the balloon yarn to the centering point at the upper end of the yarn balloon. The rotating component, however, can as well be an element which is separated from the other machine parts and which is freely entrained by the yarn itself.

If the conveyance of the fiber material toward the annular space and away from the annular space is carried out by means of a vacuum, it is expedient, as will be explained infra with the aid of embodied examples, if the annular space is sealed by gap or labyrinth seals relative to the spaces which are under a higher pressure.

BRIEF DESCRIPTION OF THE DRAWINGS

In the following, two embodiments for the method and the device according to the invention are described in detail with the aid of the enclosed drawings.

In the drawings it is illustrated in.

DESCRIPTION OF PREFERRED EMBODIMENTS

Figure 1:
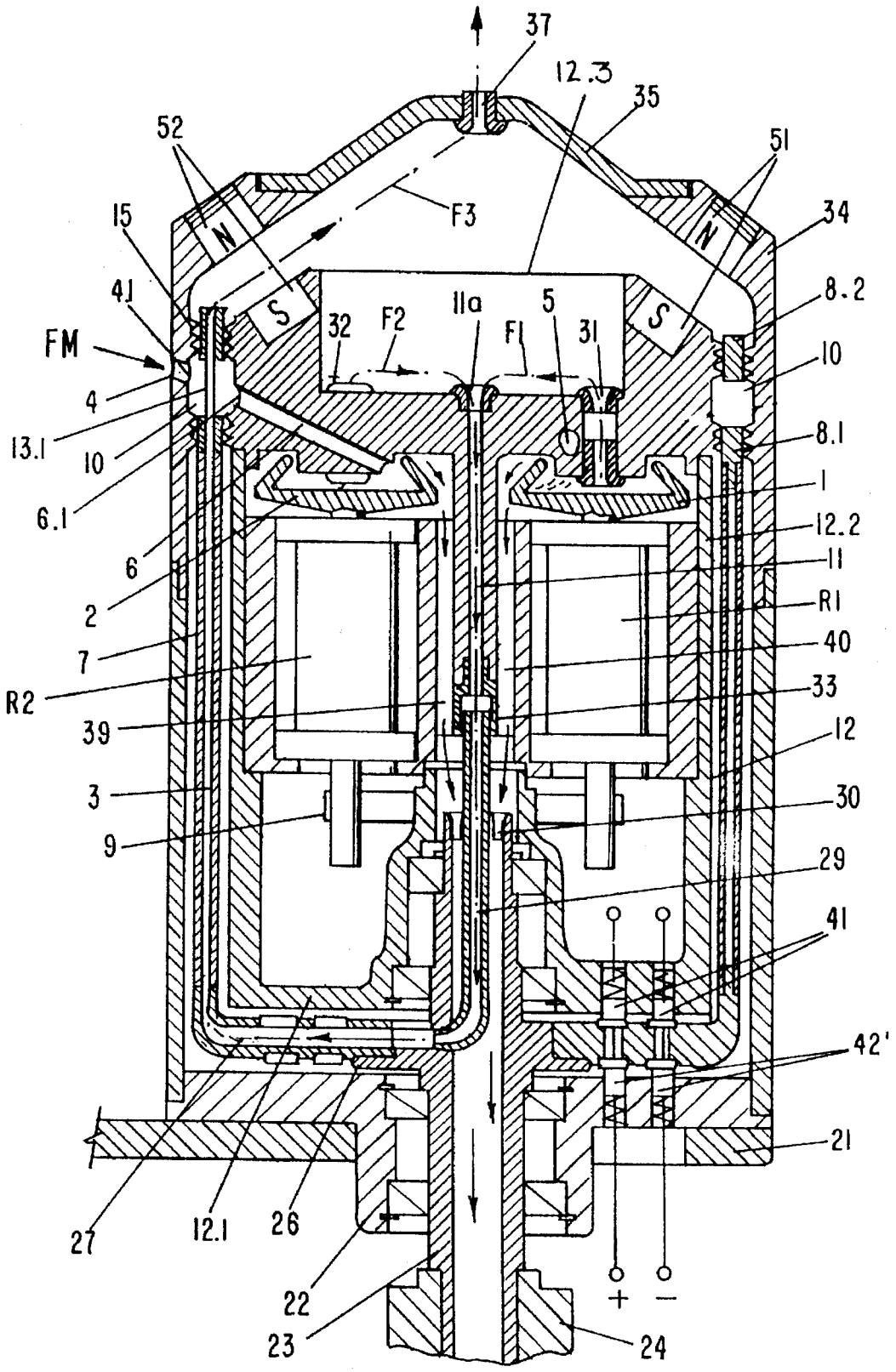
FIG. 1 a cross-sectional view of a two-for-one twisting spindle with integrated spinning devices in the form of spinning rotors.

FIG. 1 illustrates a two-for-one twisting spindle. On a machine frame schematically represented by a spindle rail 21 a hollow spindle axle 23 is rotatably supported by means of a bearing block 22; the outer, i.e., lower end of the hollow spindle axle 23 can be connected to a non-represented vacuum source. The hollow spindle axle 23 driven via the whorl 24 and a non-represented tangential drive belt forms a part of the spindle rotor and supports a radially oriented spindle rotor disk 26 with a yarn guide channel 27 which extends radially outwardly. To the outer circumference of the spindle rotor disk 26 a balloon limiter 7 is connected within the wall of which an upwardly extending yarn guide element 3 is provided; at its lower end the yarn guide element 3 is connected to the yarn guide channel 27 and at its upper end the yarn F3 exits toward the centering element 37. As a part of the hollow spindle axle 23, a yarn guiding tube 29 that is bent at its lower end opens into the inner end of the yarn guide channel 27; the yarn guiding tube 29 is inserted into the hollow spindle axle 23 such that vacuum channels 30 remain between the hollow spindle axle 23 and the yarn guiding tube 29. The spindle rotor is thus essentially formed by the following elements: hollow spindle axle 23, spindle rotor disk 26, balloon limiter 7, with yarn guide element 3, and yarn guiding tube 29.

At the upper end of the hollow spindle axle 23 an interior casing 12 is supported via interposed suitable bearings. The substantially closed interior casing 12 is secured against rotation by pairs of permanent magnets 51, 52. The interior casing 12 has essentially the form of a cylinder with a bottom 12.1, a sidewall 12.2 and a detachable lid 12.3. Within this interior casing 12 two rotor spinning devices R1 and R2 are provided, the spinning rotors 1 and 2 of which are driven by a drive belt 9 of a motor not illustrated in FIG. 1. The fiber material supply channels 5 and 6 opening into the spinning rotors 1 and 2 extend through the lid 12.3. Furthermore, spun yarn removal tubes 31 and 32 extending coaxially above the spinning rotor axes through the lid 12.3; the spun fibers F1 or F2 produced within the spinning rotors 1 and 2 are removed via the spun yarn removal tubes 31 and 32 before they are introduced through the upper inlet opening 11*a* of the downwardly extending hollow axle 11 which opens into the upper end of the yarn guiding tube 29 via, for example, an interposed annular gap seal 33.

The inner end of the hollow spindle axle 23 is connected to vacuum channels 39, 40 opening into the interior of the interior casing 12 in the area of the spinning rotors 1 and 2. The outer end of the hollow spindle axle 23 is connected in a non-represented manner to a vacuum source so that via the hollow spindle axle shaft 23 and the vacuum channels 39, 40 a vacuum is created within the interior of the interior casing 12. The vacuum acts on the fiber material supply channels 5 and 6 and effects the fiber feed into the spinning rotors 1 and 2.

The interior casing 12 is enclosed by an exterior housing 34 that has a detachable cover 35 being provided at its inner side with pairs of permanent magnets 51, 52 which cooperate with the corresponding countermagnets of the lid 12.3 of the interior casing 12 whereby a contact-free holder is created between the interior casing 12 with its fixedly mounted members and the exterior housing 34. At the upper side of the cover 35 of the exterior housing 34 a yarn outlet opening 37 is provided as a centering element positioned coaxially to the hollow axle 11; a conveying device for the twisted yarn F3 is provided downstream of the yarn outlet opening 37.

The drive motor for the rotor spinning devices R1 and R2 which is not illustrated is supplied with power through the spindle rotor disk 26 via a schematically represented system of slip ring contacts 41, 42 with adjoining electrical contacts not being illustrated. Dynamometric energy conversion can also be applied for generating and supplying the required electrical energy.

Figure 2:
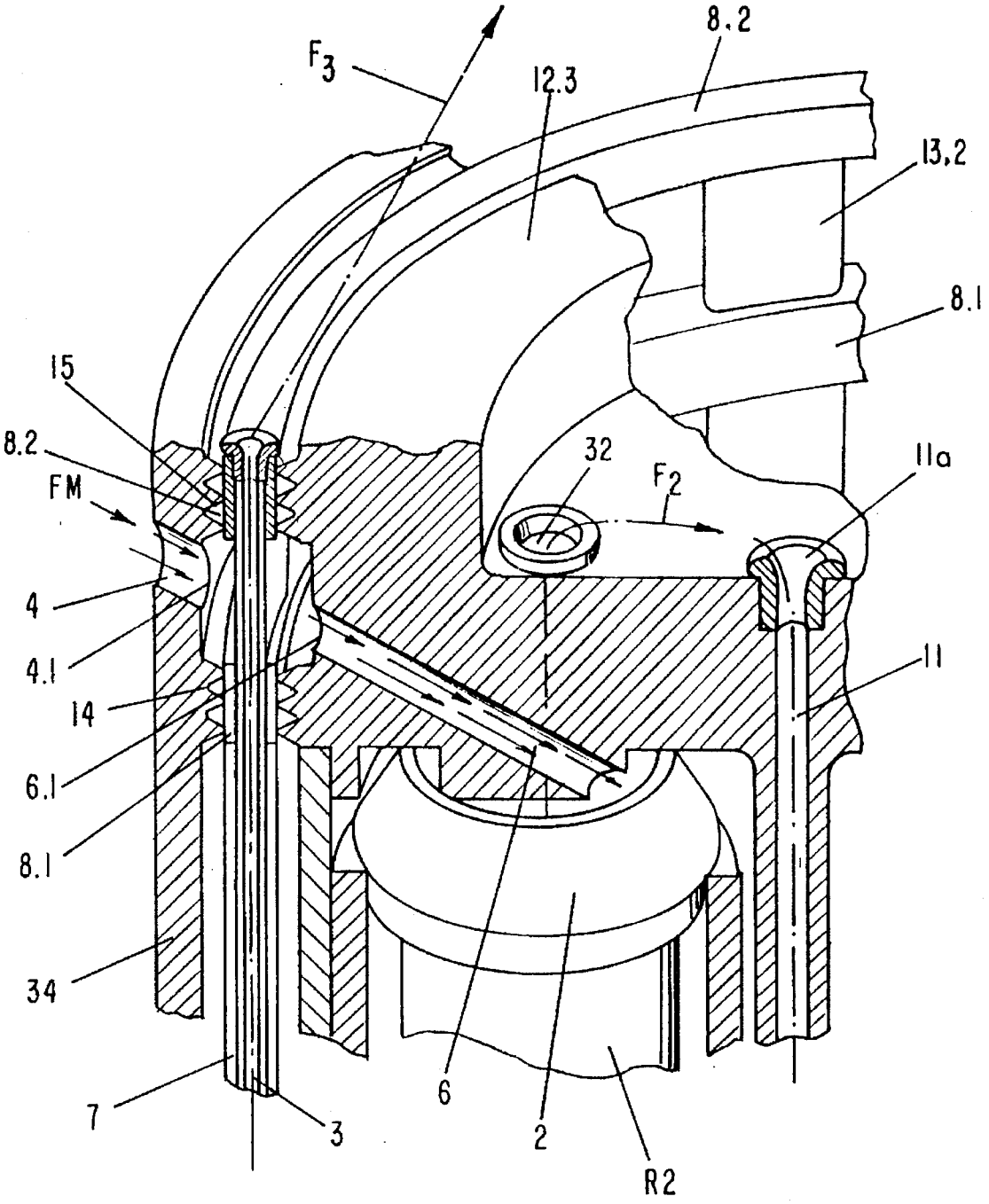
FIG. 2 partially in section a perspective view of a twisting spindle according to FIG. 1 in the area of the fiber material supply.
Figure 3:
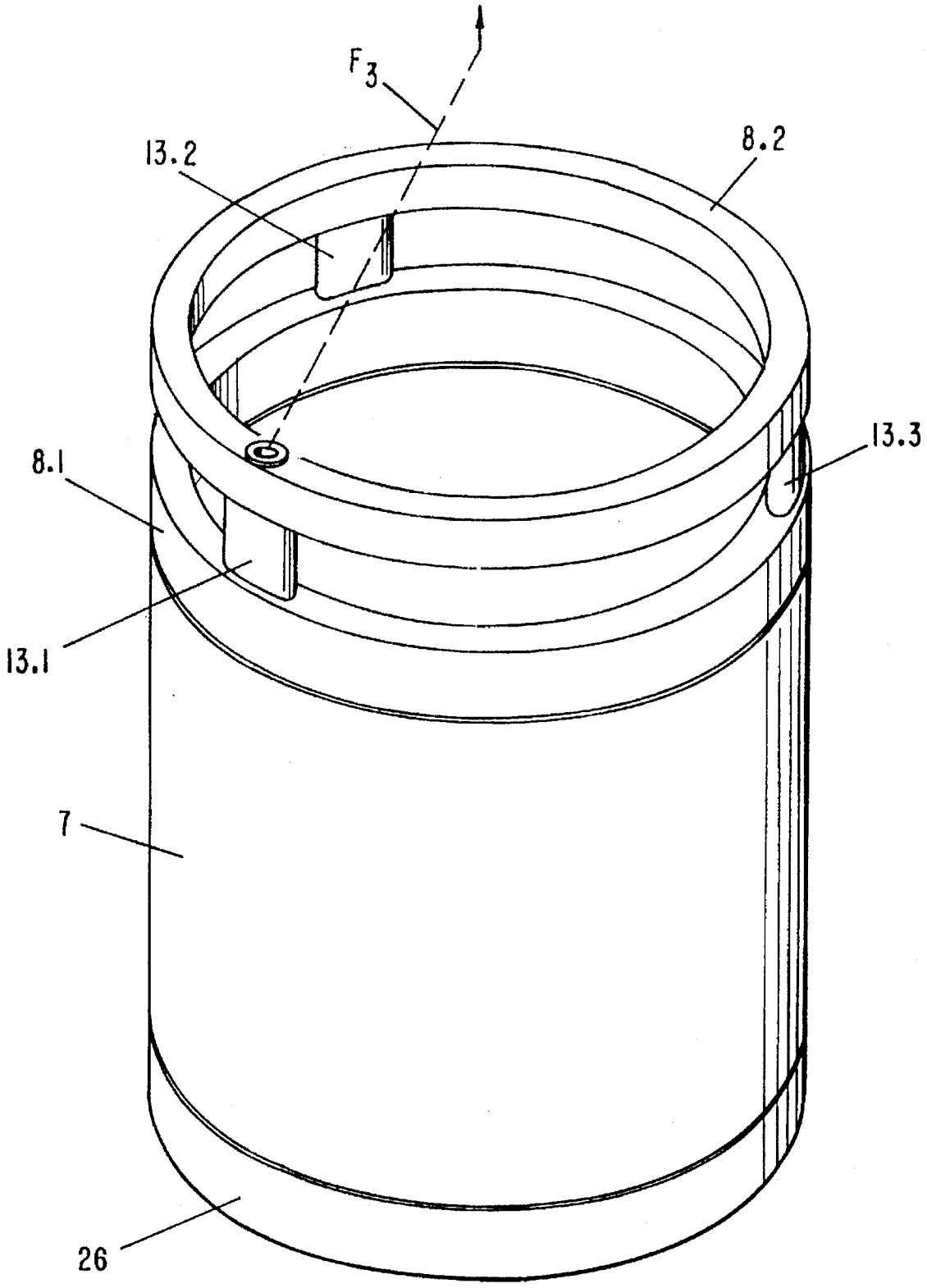
FIG. 3 in a perspective view the rotating component of the embodiment according to FIGS. 1 and 2 as a part of a balloon limiter mantle.

Fiber material feed tubes 4 (only a single one is shown in FIG. 1) for feeding the fiber material of which are provided within the exterior housing 34. The fiber material feed tube 4 has an outlet opening 4.1 that opens into the annular space 10. Off-set and opposite to the outlet opening 4.1 an inlet opening 6.1 of the fiber material supply channel 6 is provided within the lid 12.3 of the interior casing 12. The annular space 10 is delimited at its upper and its bottom side by annular members 8.1 and 8.2 which are parts of a rotating component that is provided at the upper edge of the balloon limiter 7 and thus rotate therewith. The more detailed embodiment of this balloon limiter can be seen in FIG. 3. According to this FIG. the two annular members 8.1 and 8.2 are connected to each other via spoke-shaped or pillar-shaped connecting elements 13.1, 13.2, and 13.3. The yarn guide element 3 for the twisted yarn F3 extends through the connecting element 13.1. It can be easily seen that the fed fiber material stream FM is introduced from the outlet opening 4.1 into the inlet opening 6.1 through the annular space 10 as long as the passage is not covered up by one of the connecting elements 13.1 to 13.3. The width of the connecting elements 13.1 to 13.3 in the circumferential direction is essentially a function of the maximum length of the fibers within the fed fiber material. This width should be larger than half of the fiber length of the longest fiber of the fed fiber material. Under these conditions a winding of individual fibers around the connecting elements thus interfering to a larger extent with the feeding of the fiber material is prevented. The connecting elements 13.1 to 13.3 are preferably designed in the rotational direction in the shape of a wing profile for reducing aerodynamic losses. Since the width of the connecting elements 13.1 to 13.3 is defined, the overlap is essentially a function of the radius of the annular space 10 and the number of the connecting elements 13.1 to 13.3. It has proven to be sufficient to provide three connecting elements and it is very advantageous if the radius of the annular space 10 is as large as possible, i.e., if the rotating component is positioned at a location which corresponds to the largest radial extension of the interior casing 12. This is the case in the embodiments according to FIGS. 1 to 3. The offset position of the inlet opening 6.1 relative to the outlet opening 4.1 in the direction of rotation of the annular members 8.1 to 8.2 preferably corresponds to the equation: S=B/VF·VS in which S=offset, B=radial width of the annular space 10, VF=velocity of the fed fibers, and VS =circumferential velocity of the connecting elements 13.1 to 13.3.

Figure 4:
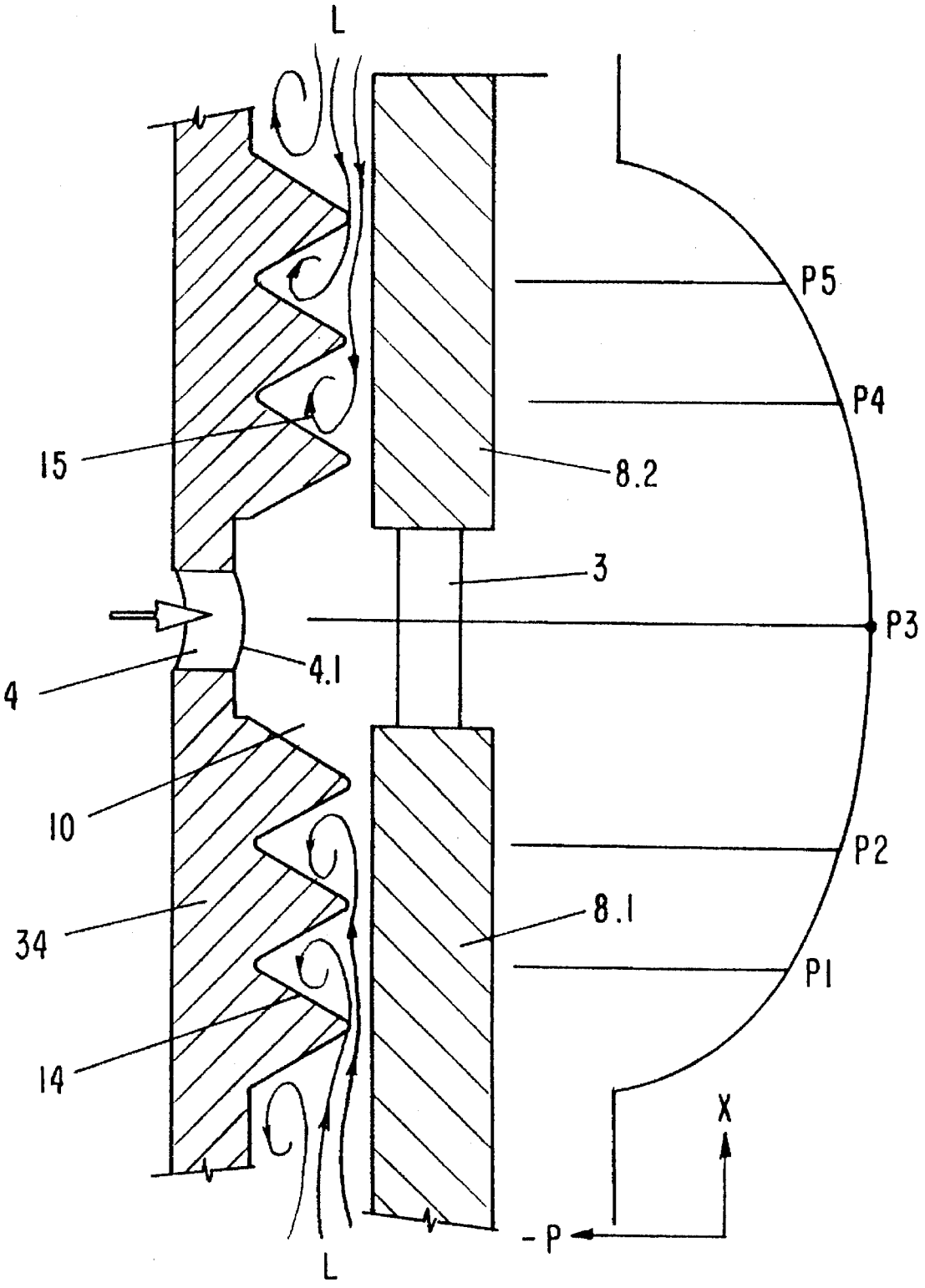
FIG. 4 a greatly enlarged section of the area of the fiber supply to the annular space in the embodiments according to FIGS. 1 to 3 in conjunction with a graphical illustration of the pressure distribution within the slots between annular space and exterior space.

The conveyance of the fiber material to be fed through the fiber material feed tubes 4 and the fiber material supply channels 5 and 6 is carried out by means of a vacuum. The vacuum within the interior of the interior casing 12 extends into the annular space 10 via the fiber material supply channels 5 and 6. In order that a sufficient vacuum can be produced within this annular space, gap seals 14, 15 preferably in the form of labyrinth seals are provided within the gaps connecting the annular space 10 with the spaces being under a higher pressure between outer wall of the interior casing 12 and the inner wall of the exterior housing 34; the more detailed embodiment and function of the gap seals 14, 15 can be seen in FIGS. 2 to 4. Advantageously, these gap seals 14 and 15 are provided in circumferential direction of the gaps with return threads with opposite pitch relative to the annular space such that the air streaming into the annular space 10 from the exterior is being blocked due to the opposite pitch. This is illustrated in more detailed in FIG. 4. FIG. 4 illustrates a section within the area of the gap between the lower annular member 8.1, respectively, the upper annular member 8.2 and the inner wall of the exterior housing 34. The air streaming in from the exterior is indicated by air-flow lines L. In a known manner, pressure energy is transformed within the seal into velocity energy whereby a choking action is produced. On the right-hand side of FIG. 4 the flow of the vacuum –P in the circumferential direction X indicated by a small system of coordinates is represented in a diagram. It can be seen that the pressure drops from point P1 via P2 to point P3 corresponding to the center of the annular space 10 and then increases again outwardly along points P4 and P5.

In the following a slightly different embodiment of the rotating component delimiting the annular space is described with the aid of FIG. 5.

Figure 5:
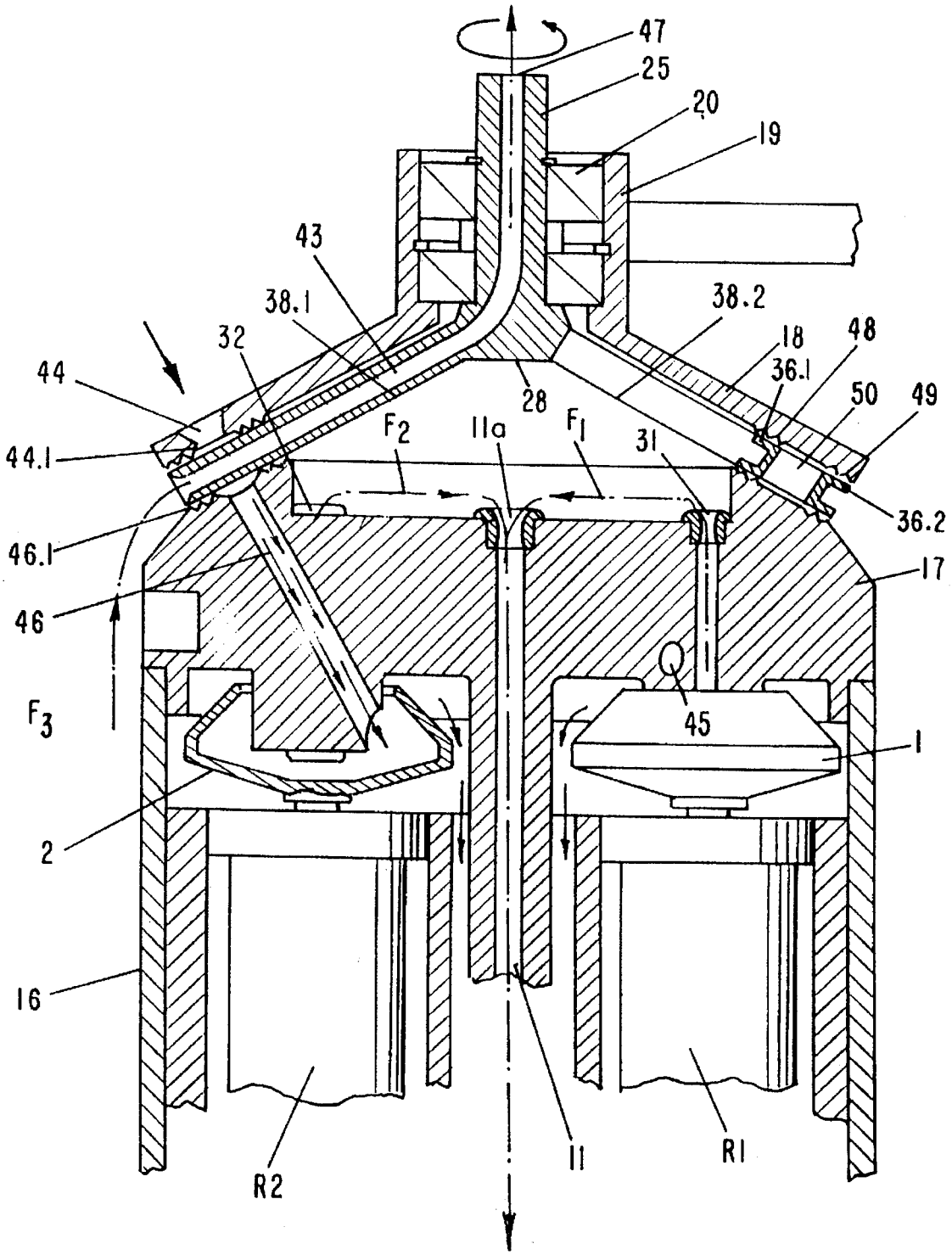
FIG. 5 a partial section of a two-for-one twisting spindle with spinning rotors analogous to FIG. 1 in a different embodiment of the fiber material supply.

In FIG. 5 only those structural members that are different from the embodiment according to FIGS. 1 to 4 are illustrated in more detail and provided with reference numerals of their own. The two-for-one twisting spindle illustrated in FIG. 5 corresponds in its remaining structure to the two-for-one twisting spindle according to FIGS. 1 to 4.

According to FIG. 5 the rotating component is embodied as a conically shaped wheel 28 positioned above the spindle and being located above the lid 17 of the interior casing 16. Its wheel axle is supported on a fixed holder 19 with a pivot bearing 20. At the outer circumference of the wheel 28 two annular members 36.1 and 36.2 are positioned which delimit the circular hollow space 50 located between them; the circular hollow space 50 is bordered on both sides by the inner wall of an also conically shaped exterior housing 18 and the outer wall of the lid 17 of the interior casing 16. The two annular memberes 36.1 and 36.2 are connected to each other via spoke-shaped connecting elements 38.1 and 38.2. The connecting element 38.1 is penetrated by a balloon yarn guide element 43 at the lower end of which the twisted yarn F3 passing through the yarn balloon enters to be guided toward the centering element 47 where it is removed.

The fiber material feed tubes 44 (only a single one is visible in the FIG.), the outlet opening 44.1 of which open into the annular space 50, extend through the exterior housing 18. Opposite the fiber material feed tubes 44 and offset relative to them the inlet openings 46.1 of the fiber material supply channels 46 or 45 are located which open into the rotors 2 or 1 of the rotor spinning device R2, respectively, R1.

For sealing the gap between the inner wall of the exterior housing 18 and the outer wall of the lid 17 through which air can stream into the annular space 50 gap seals 48 and 49 of the structure already described are provided. Also with the embodiment according to FIG. 5 it is achieved that the annular space has a relatively large radius and that the overlap of the outlet, respectively, the inlet openings is reduced. The driving device itself for the conically shaped wheel 28 is not illustrated. It can be constructed with structural members known to the expert.

The present invention is, of course, in no way restricted to the specific disclosure of the specification and drawings, but also encompasses any modifications within the scope of the appended claims.

What we claim is:

1. A method for manufacturing a twisted yarn by an integrated spinning-twisting process; said method comprising the steps of:

generating a vacuum within a rotating spindle rotor;

dissolving fiber material to produce individual staple fibers;

feeding the individual staple fibers by means of said vacuum to at least two rotor spinning devices positioned within the spindle rotor;

spinning in the rotor spinning devices individual spun yarns from the individual staple fibers;

gathering the individual spun yarns from the rotor spinning devices and guiding the individual spun yarn in a first direction through the spindle rotor in order to subject the individual spun yarns to a first twist to form a twisted yarn;

guiding the twisted yarn in a second direction counter to said first direction to a centering element positioned above the rotor spinning devices whereby the twisted yarn forms a rotating yarn balloon about the spindle rotor;

winding the twisted yarn onto a bobbin;

wherein said step of feeding the individual staple fibers includes the steps of supplying essentially in a radially inward direction relative to the axis of rotation of said spindle rotor the individual staple fibers through a fiber material feed tube to an annular space, positioned at the spindle rotor coaxially to a central axis of the yarn balloon, and from the annular space through respective fiber material supply channels to the at least two rotor spinning devices, wherein the envelope of the yarn balloon extends through the annular space and wherein the individual staple fibers pass through the yarn balloon; and wherein said step of guiding the twisted yarn in a second direction counter to said first direction includes the step of routing the twisted yarn through a yarn guide element rotating with the yarn balloon.

2. A method according to claim 1, further including the step of positioning the outlet opening of the fiber material feed tube into the annular space and the inlet opening of the fiber material supply channel into the annular space radially opposite one another.

3. A method according to claim 1, further including the step of positioning the outlet opening of the fiber material feed tube into the annular space so as to be spaced in the circumferential direction of the annular space from the inlet opening of the fiber material supply channel into the annular space in a direction of rotation of the yarn balloon.

4. A spinning and twisting device comprising:

a spindle rail;

at least one spindle comprising a spindle rotor rotatably connected to said spindle rail, an interior casing surrounding said spindle rotor coaxially, and an exterior housing enclosing said interior casing;

said spindle rotor comprising a hollow spindle axle and a yarn guide channel connected to said hollow spindle axle so as to extend radially outwardly from said hollow spindle axle;

a centering element positioned above said hollow spindle axle on an extension of the axis of rotation of said hollow spindle axle;

at least two rotor spinning devices positioned within said interior casing;

a device for feeding individual staple fibers to said at least two rotor spinning devices, wherein the individual staple fibers are spun to spun yarns in the rotor spinning devices, guided through said hollow spindle axle and through said yarn guide channel to the exterior of said interior casing and to said centering element while forming a yarn balloon between said yarn guide channel and said centering element;

a fiber material supply channel positioned within said interior casing for each one of said rotor spinning devices for feeding fiber material to each one of said rotor spinning devices;

each one of said fiber material supply channels having an inlet opening at the outer wall of said interior casing;

a fiber material feed tube located in said exterior housing for each one of said fiber material supply channels for feeding fiber material to each one of said fiber material supply channels, said fiber material feed tubes having an outlet opening positioned at an inner wall of said exterior housing;

a spun yarn removal tube for each one of said rotor spinning devices for guiding the spun yarns from said rotor spinning devices to said hollow spindle axle where a twisted yarn is formed from the spun yarns;

a rotating component arranged coaxially to said hollow spindle axle between said interior casing and said exterior housing and rotating with the yarn balloon, said rotating component comprising an integral yarn guide element for guiding at least over a portion of the height of the yarn balloon the twisted yarn;

said rotating component comprising two annular members positioned opposite one another so as to delimit therebetween an annular space into which said inlet opening of said fiber material supply channels and said outlet opening of said fiber material feed tubes open; and said rotating component further comprising at least one connecting element for connecting said two annular members, said connecting elements extending through said annular space, wherein said integral yarn guide element extends through one of said at least one connecting elements.

5. A device according to claim 4, wherein said inlet openings of said fiber material supply channels are spaced in the circumferential direction of the annular space from the inlet opening of the fiber material supply channel into the annular space in a direction of rotation of the rotating component.

6. A device according to claim 4, wherein three of said connecting elements are provided.

7. A device according to claim 4, wherein between said inner wall of said exterior housing and said annular members first gaps are formed and wherein between said outer wall of said interior casing and said annular members second gaps are formed, said device further comprising gap seals in the form of labyrinth seals for said first and second gaps, wherein said annular space is subjected to a vacuum.

8. A device according to claim 7, wherein said labyrinth seals in a circumferential direction of said annular space have return threads of opposite pitch orientation relative to said annular space.

9. A device according to claim 4, wherein a width of said at least one connecting element in a circumferential direction of said rotating component is greater than half a length of a longest individual staple fiber within the supplied fiber material.

10. A device according to claim 4, wherein said annular space is positioned at a maximum radial extension of said interior casing.

11. A device according to claim 4, wherein:

said rotating component is a pot fixedly connected to said spindle rotor;

said annular members are positioned at an upper end of said pot; and said yarn guide element extends through a wall of said pot upwardly into one of said at least one connecting elements.

12. A device according to claim 4, wherein:

said rotating component is a wheel of a conical shape rotatably connected above said spindle rotor in the area of said centering element;

said conical shape has a tip that faces away from said interior casing;

said wheel has an outer edge that overlaps the upper edge of said interior casing;

said annular members connected to said outer edge;

said yarn guide element being in the form of a yarn guide tube extending from said outer edge through one of said at least one connecting elements to said centering element; and said exterior housing comprising a stationary cover positioned above said wheel.

* * * * *